US010767377B1

(12) United States Patent
Axmaker

(10) Patent No.: US 10,767,377 B1
(45) Date of Patent: Sep. 8, 2020

(54) CONCRETE FORM SPREADER

(71) Applicant: Jason L. Axmaker, Jefferson, OR (US)

(72) Inventor: Jason L. Axmaker, Jefferson, OR (US)

( * ) Notice: Subject to any disclaimer, the term of this patent is extended or adjusted under 35 U.S.C. 154(b) by 598 days.

(21) Appl. No.: 15/269,323

(22) Filed: Sep. 19, 2016

Related U.S. Application Data

(60) Provisional application No. 62/220,268, filed on Sep. 18, 2015.

(51) Int. Cl.
*E04G 17/12* (2006.01)
*E04G 21/02* (2006.01)
*E04G 17/065* (2006.01)

(52) U.S. Cl.
CPC ..... *E04G 17/12* (2013.01); *E04G 17/0658* (2013.01); *E04G 21/02* (2013.01)

(58) Field of Classification Search
CPC ..... E04G 17/12; E04G 17/0658; E04G 21/02
USPC ..... 264/333
See application file for complete search history.

(56) References Cited

U.S. PATENT DOCUMENTS 1,788,180 A 1/1931 White
4,495,131 A * 1/1985 Del Valle ..... B28B 7/22 264/256
4,541,211 A * 9/1985 Garrett ..... E04B 2/84 249/217
4,598,519 A 7/1986 Reid
9,074,379 B2 * 7/2015 Ciuperca ..... E04G 9/10
2008/0220268 A1 9/2008 Scott et al.
2010/0024346 A1 2/2010 Strahin
2012/0240483 A1 9/2012 Sladojevic

OTHER PUBLICATIONS

Quikrete Concrete Dobie Block (Common: 3-in×3-in×2-in; Actual: 2.625-in×2.625-in×1.625-in). Product Listing [online]. Quikrete, 2016. [Retrieved on Jun. 30, 2015]. Retrieved from the Internet: http://www.lowes.com/pd_82536-286-098083_0__?productId=3044208.

Pair Stainless Steel Black Cube Barbell Stud Earrings 4mm. Product Listing [online]. Steelmeup, 2013. [Retrieved on Jun. 30, 2015]. Retrieved from the Internet: http://www.amazon.com/Stainless-Steel-Black-Barbell-Earrings/dp/B00DN9VSOC.

* cited by examiner

*Primary Examiner* — Christina A Johnson
*Assistant Examiner* — Xue H Liu
(74) *Attorney, Agent, or Firm* — Cramer Patent & Design, PLLC; Aaron R. Cramer

(57) ABSTRACT

A concrete formwork spreading device includes a tie rod including opposing ends, and a pair of end caps connected to the opposing ends of the tie rod. Each one (1) of the pair of end caps includes a contacting face, wherein the contacting face is flat. Each one (1) of the opposing ends of the tie rod is one (1) of permanently connected or removably connected to an associated one (1) of one (1) pair of end caps. The contacting face of each one (1) of the pair of end caps is spaced apart by a distance, the distance is equal to a thickness of a concrete wall formed using the device. The distance between the contacting face of each one (1) of the pair of end caps is one (1) of fixed or adjustable.

11 Claims, 4 Drawing Sheets

CONCRETE FORM SPREADER

RELATED APPLICATIONS

The present invention claims the benefit of U.S. Provisional Application No. 62/220,268 filed on Sep. 18, 2015, the entire disclosures of which are incorporated herein by reference.

FIELD OF THE INVENTION

The present invention relates generally to the field of concrete construction and, more particularly, to a spreader for reinforcement bar support structures and concrete formworks used in concrete construction.

BACKGROUND OF THE INVENTION

In general, concrete construction often requires a formwork to maintain the specified shape and dimensions of the concrete structure, such as a concrete wall, during the pouring of the concrete. In order to maintain the required shape and specifications, the formwork must be properly reinforced because the weight of the wet, flowable concrete can alter the shape of the walls of the formwork without such proper reinforcing. In certain applications, adequately reinforcing the formwork with external bracing can be expensive due to the cost of the additional materials and labor. Additionally, often there is inadequate space around the forms to provide proper reinforcing and structural support to hold the concrete forms.

To prevent the forms from moving outward away from the concrete, ties are generally used to resist the outward forces of the concrete by pulling the forms inwardly. These ties are generally permanently embedded within the concrete and cannot be removed once the concrete has been set. These types of ties often pose problems when the completed concrete walls are indented to be sealed to prevent water from seeping in or out of the completed concrete wall.

Further, to prevent the concrete formwork from bowing inwardly, the forms must either be externally reinforced or have a spreader installed within the formwork to push outwardly on the formwork. One (1) disadvantage of the current method for spreading the form is that the spreading devices sometimes interfere with the fabrication of the reinforcing structure of the concrete wall. Additionally, spreaders can often pose problems with sealing the concrete wall from leaking water from or into the concrete walls.

Accordingly, there exists a need for a concrete formwork spreader that addressed the disadvantages described above.

SUMMARY OF THE INVENTION

The inventor has recognized the aforementioned inherent problems and lack in the art and observed that there is a need for a device to maintain a concrete formwork from bowing inwardly during concrete construction, while maintaining the ability to provide a concrete wall that provides adequate sealing from water moving into or out of the completed concrete wall. The development of the present invention, which will be described in greater detail herein, fulfills this need.

In an exemplary embodiment, the disclosed concrete formwork spreading device includes a tie rod including opposing ends, and a pair of end caps connected to the opposing ends of the tie rod. Each one (1) of the pair of end caps includes a contacting face, wherein the contacting face is flat. Each one (1) of the opposing ends of the tie rod is one (1) of permanently connected or removably connected to an associated one (1) of one (1) pair of end caps. The contacting face of each one (1) of the pair of end caps is spaced apart by a distance, the distance is equal to a thickness of a concrete wall formed using the device. The distance between the contacting face of each one (1) of the pair of end caps is one of fixed or adjustable.

In another exemplary embodiment, the disclosed method for forming a concrete structure includes the steps of: 1). constructing a reinforcing frame including a plurality of reinforcing bars, 2). using at least one (1) concrete formwork spreading device including a tie rod including opposing ends, and a pair of end caps connected to the opposing ends of the tie rod, 3). placing at least one (1) concrete formwork spreading device in contact with and supported by an opposing pair of the plurality of reinforcing bars, 4). constructing a formwork around the reinforcing frame with the pair of end caps abutting an interior surface of the formwork, and 5). pouring concrete within the framework and around the reinforcing frame and the at least one (1) concrete formwork spreading device.

Furthermore, the described features and advantages of the disclosure may be combined in various manners and embodiments as one skilled in the relevant art will recognize The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
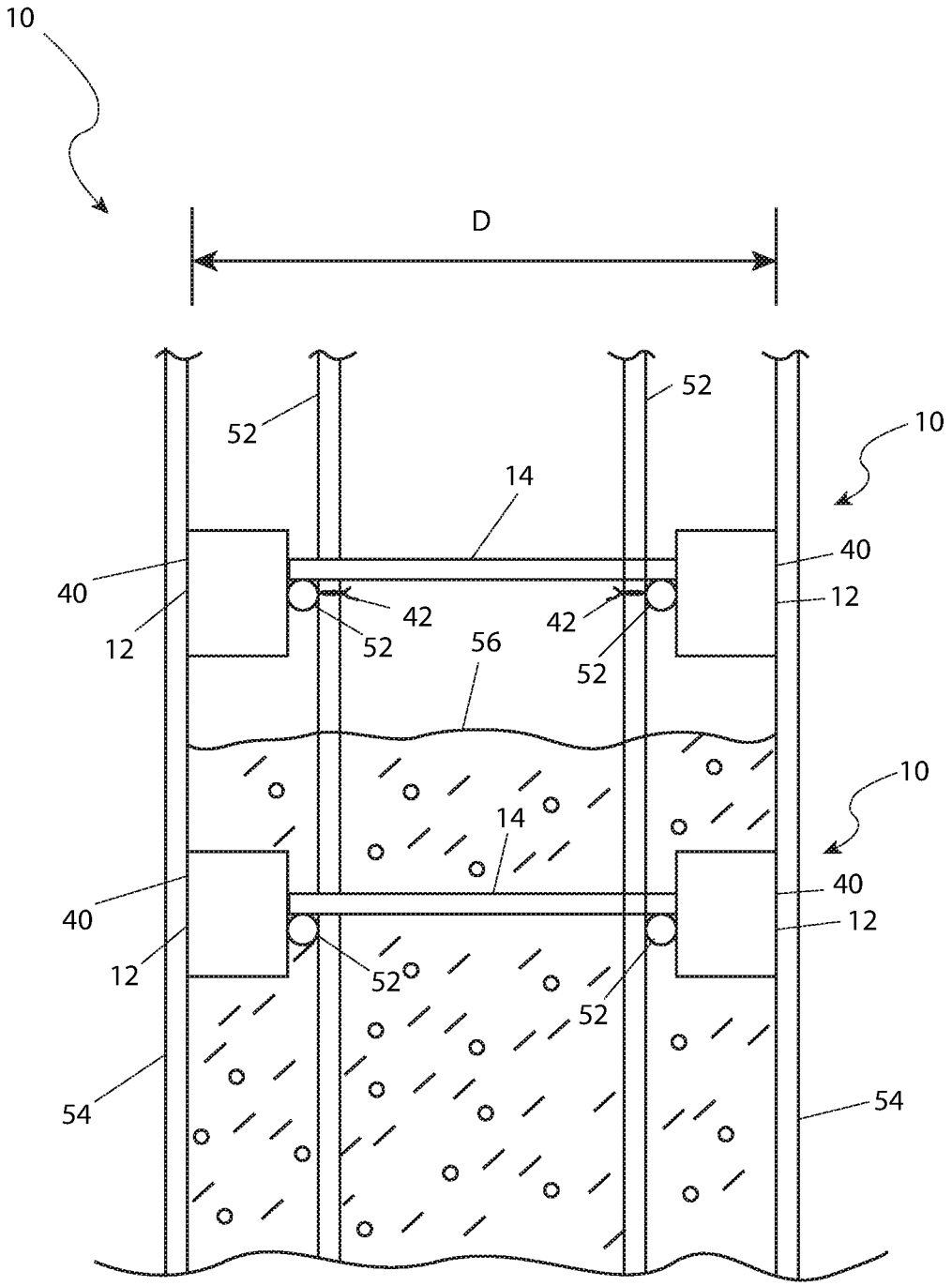
FIG. 1 is an environmental side elevation view of an embodiment the disclosed concrete form spreader used during formation of a concrete wall.

10 concrete form spreader
10*a* fixed concrete form spreader
10*b* adjustable concrete form spreader
12 end cap
14 tie rod
16 end of tie rod
18 first tie rod section
20 second tie rod section

22 turnbuckle
24 first end of tie rod section
26 second end of tie rod section
28 coupling nut
30 plate washer
32 first end of turnbuckle
34 second end of turnbuckle
36 body of end cap
38 wing of end cap
40 contacting face
42 tie wire
44 thread
50 reinforcing frame
52 reinforcing bar
54 formwork
56 concrete

DETAILED DESCRIPTION OF THE PREFERRED EMBODIMENT

In accordance with the invention, the best mode is presented in terms of exemplary embodiments, herein depicted within FIGS. 1-8. However, the invention described herein is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

Referring to FIGS. 1-8, disclosing a concrete form, or formwork, spreader, herein generally referred to as a device 10, where like reference numerals represent similar or like parts. Generally, the disclosed device 10 is directed to a concrete formwork spreader in either an adjustable embodiment or a fixed embodiment.

Generally, the disclosed device 10 is a forming aid for use when pouring concrete walls. The device 10 generally includes two (2), for example, cubical, pieces of concrete or "dobies" that are cast around a short section of reinforcing bar or "rebar". In various embodiments, the device 10 may be made available in multiple sizes to fit numerous different types of wall construction styles and thicknesses.

In an exemplary embodiment, the overall outside length of the device 10 is approximately the same as a wall thickness. The device 10 may be attached to existing rebar wall reinforcement with the use of tie wires 42. The dobies ensure that the rebar remains at the proper recessed distance, while the rebar aids in holding the dobies in place, as well an insuring that the existing reinforcing rebar is properly positioned before the concrete pour and remains in place during the entire concrete pour. The ability to hold the reinforcing rebar in place also ensures that the reinforcing rebar does not drift into the middle of the wall where its strength qualities will be diminished. The dobies also make contact with the walls of the formwork to prevent the formwork from flexing inwardly during concrete construction.

The present disclosure recognizes various advantages provided by the disclosed device 10, such as saving time during the wall forming process and ensuring a higher quality finish product that is the exact thickness required.

FIG. 1 is a schematic illustration of an environmental side elevation view of one (1) embodiment of the disclosed device 10. The device 10 includes two opposed end caps 30. In an example, the end caps 30 are concrete blocks, also referred to as dobie blocks or dobies. The end caps 30 are connected to a tie rod 14. The tie rod 14 spaces the end caps 12 apart from each other by a predetermined distance D. The distance D may be substantially equal to the thickness of the concrete wall being formed. The end caps 12 abut an interior surface of the concrete formwork 54 to provide resistance to the inward deflection of the formwork 54. The end caps 30 are consumed within the process of forming a concrete wall as the concrete 56 hardens around them and will be permanently embedded in the finished concrete wall upon removal of the concrete formwork 54.

As illustrated in FIG. 1, in an example implementation of use, the device 10 may be used to appropriately space different sections of reinforcing bars 52 of a reinforcing frame 50, or rebar mesh, used when pouring and forming a concrete structure, such as a concrete wall. As an example, the tie rod 14 may be positioned on and supported by a pair of opposing horizontally oriented reinforcing bar 52. The opposed end caps 12 restrict movement of horizontally oriented and/or vertically oriented reinforcing bars 52, for example, during the pour of concrete into a formwork over the reinforcing frame 50. The tie rod 14 may be secured to one (1) or more horizontal and/or vertical reinforcing bars 52, for example, with tie wire 42.

Thus, the device 10 serves to appropriately position and space the sections of reinforcing bars 52 within the poured concrete wall.

Figure 2:
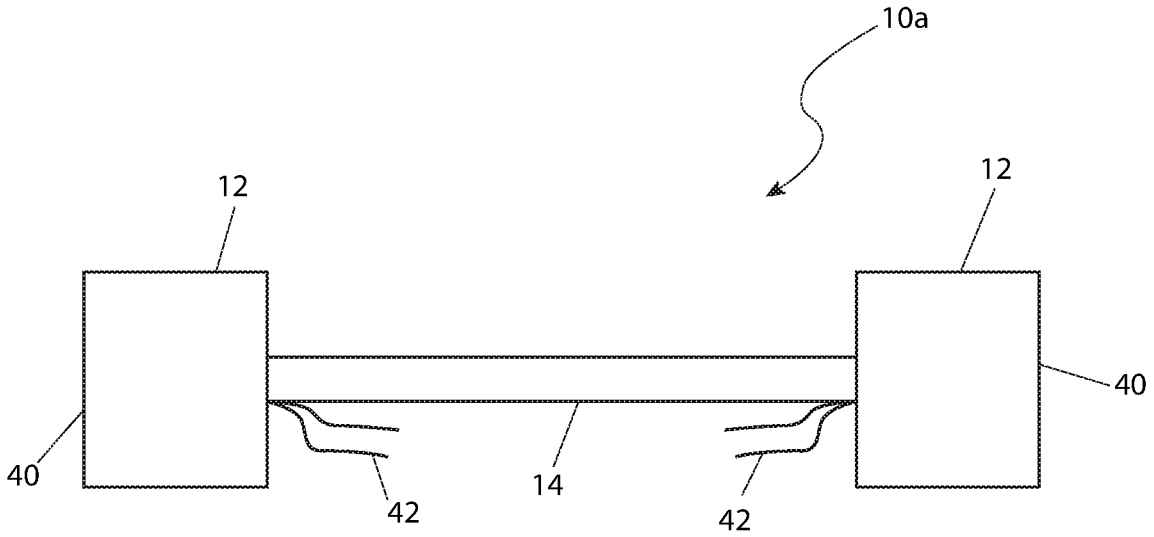
FIG. 2 is a side elevation view of another embodiment of the disclosed concrete form spreader.

FIG. 2 is a schematic illustration of a side elevation view of one embodiment of the disclosed device 10. The embodiment illustrated in FIG. 2 depicts the fixed concrete form spreader, also generally referred to herein as the fixed device 10*a*. The device 10*a* includes the two opposed end caps 12. The end caps 12 are coupled to the tie rod 14. The length of the tie rod 14 and the dimensions of the end caps 12, defining the overall dimension D of the device 10*a*, may depend upon the ultimate thickness of the concrete wall being formed. Thus, in this embodiment, the dimension D of the device 10*a* is fixed.

Figure 3:
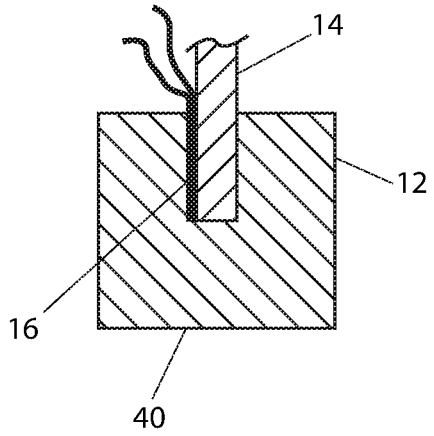
FIG. 3 is a cross-sectional view of an embodiment of an end cap of the disclosed concrete form spreader.

FIG. 3 is a schematic illustration of a partial section view of the device 10*a* depicting an embodiment of the end cap 12. In this embodiment, the end caps 12 are permanently connected (e.g., affixed) to the tie rod 14. In an example construction of this embodiment, the end caps 12 are concrete blocks formed, for example, cast, around each end 16 of the tie rod 14. Because the end caps 12 are made of concrete, there is no need for further sealing of the concrete structure at the intersection of the end caps 12 and the finished wall. In an example construction of this embodiment, the tie rod 14 is a section of reinforcing bar, also known as rebar, such as a section of steel rebar.

Figure 4:
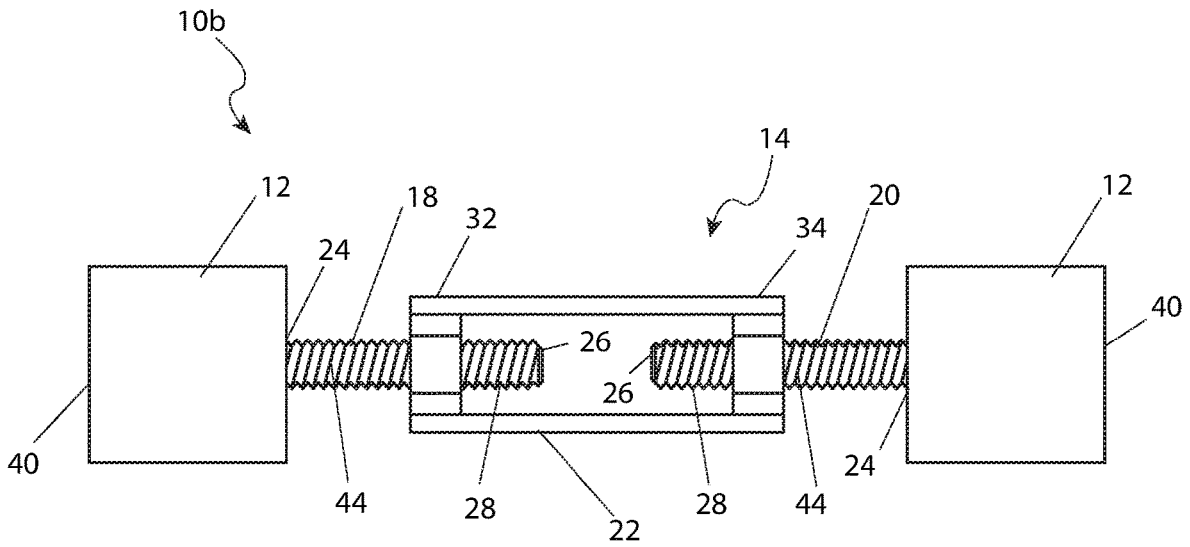
FIG. 4 is a side elevation view of another embodiment of the disclosed concrete form spreader.

FIG. 4 is a schematic illustration of a side elevation view of another embodiment of the disclosed device 10. The embodiment illustrated in FIG. 4 depicts the adjustable concrete form spreader, also generally referred to herein as the adjustable device 10*b*. The device 10*b* includes the two (2) opposed end caps 12. In this embodiment, the length of the tie rod 14 is adjustable. The tie rod 14 includes a first tie rod section 18, a second tie rod section 20 and a turnbuckle 22. A first one (1) of the end caps 12 is coupled to the first tie rod section 18. A second one (1) of the end caps 12 is coupled to the second tie rod section 20. Each tie rod section 18, 20 includes a first end 24 and a second end 26. In an example construction of this embodiment, at least a portion of the length of each tie rod section 18, 20 includes thread 44 (e.g., external threading), for example, at or near the second end 26. In another example construction of this embodiment, the entire length of each tie rod section 18, 20 includes thread 44.

The turnbuckle 22 is threadingly connected to the second end 26 of each tie rod section 18, 20 to interconnect the tie rod sections 18, 20. The turnbuckle 22 is configured to be used to adjust the height or the width of the concrete formwork prior to pouring the concrete 56 (FIG. 1) of the concrete wall. The turnbuckle 22 has a first end 32 where the first tie rod section 18 is capable of adjustable extension outwardly therefrom and a second end 34 where the second tie rod section 20 is capable of adjustable extension outwardly therefrom. The length of the tie rod 14 and the dimensions of the end caps 12 may depend upon the ultimate thickness of the concrete wall being formed. The turnbuckle 22 adjusts (e.g., shortens or lengthens) the length of the tie rod 14 in response to rotation of the turnbuckle 22 relative to the tie rod sections 18, 20. Thus, in this embodiment, the dimension D of the device 10*b* is adjustable.

Figure 5:
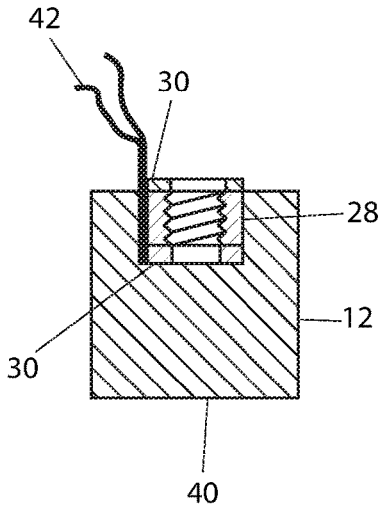
FIG. 5 is a cross-sectional view of another embodiment of an end cap of the disclosed concrete form spreader.

FIG. 5 is a schematic illustration of a partial section view of the device 10*b* depicting another embodiment of the end cap 12. In this embodiment, the end caps 12 are removably connected (e.g., attached) to the tie rod sections 18, 20. Each one (1) of the end caps 12 includes a coupling nut 28 embedded within the end cap 12. In an example construction of this embodiment, the end caps 12 are concrete blocks formed, for example, cast, around the coupling nut 28. The location and/or position of the coupling nut 28 within the end cap 12 may vary, however, in the illustrated embodiment, the coupling nut 28 is positioned flush with an exterior surface of the end cap 12 at an approximate center of one (1) side of the end cap 12. Because the end caps 12 are made of concrete, there is no need for further sealing of the concrete structure at the intersection of the end caps 12 and the finished wall. In an example construction of this embodiment, each of the tie rod sections 18, 20 may be a section of threaded rod, coil rod or the like.

The coupling nut 28 includes a threaded inner diameter configured to matingly engage the thread 44 of the tie rod sections 18, 20. In an example construction of this embodiment, the end cap 12 may also include one (1) or more plate washers 30. As one (1) example, a plate washer 30 is positioned between the coupling nut 28 and the interior surface of the end cap 12. As another example, a plate washer 30 is positioned over the exposed end of the coupling nut 28. As yet another example, a plate washer 30 is positioned between the coupling nut 28 and the interior surface of the end cap 12 and over the exposed end of the coupling nut 28. In any of these examples, the plate washer 30 may be bonded, for example, with an epoxy, to the end cap 12 and/or the coupling nut 28.

Figure 6:
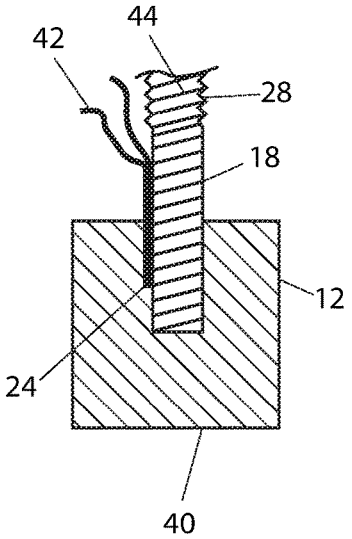
FIG. 6 is a cross-sectional view of another embodiment of an end cap of the disclosed concrete form spreader.

FIG. 6 is a schematic illustration of a partial section view of the device 10*b* depicting another embodiment of the end cap 12. In this embodiment, the end caps 12 are permanently connected (e.g., affixed) to the tie rod sections 18, 20 (only the first tie rod section 18 is shown in FIG. 6). In an example construction of this embodiment, the end caps 12 are concrete blocks formed, for example, cast, around the first end 24 of each tie rod section 18, 20. Because the end caps 12 are made of concrete, there is no need for further sealing of the concrete structure at the intersection of the end caps 12 and the finished wall. In an example construction of this embodiment, each of the tie rod sections 18, 20 may be a section of threaded rod, coil rod or the like.

In embodiments illustrated in FIGS. 2-6, each one of the end caps 12 has an approximately cubical shape. However, in other embodiments, the shape of the end caps 12 may vary depending upon the particular application or implementation of the device 10. As examples, the end caps 12 may have various other three-dimensional, for example, polyhedron, shapes.

Figure 7:
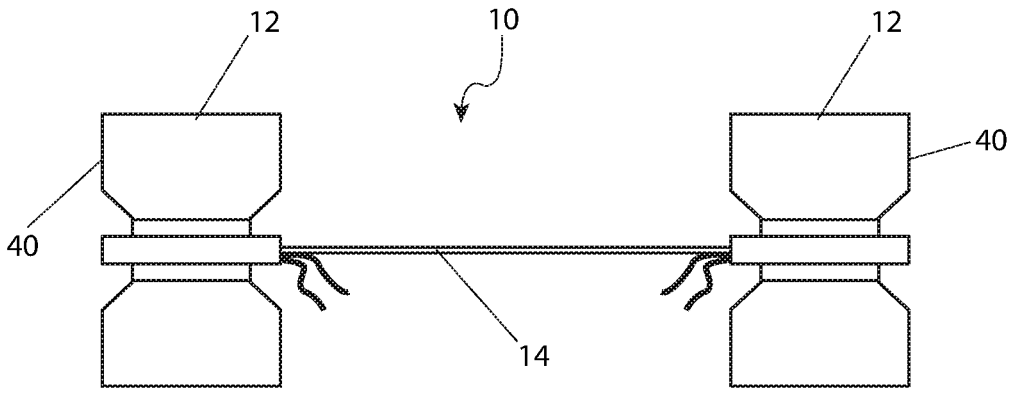
FIG. 7 is a side elevation view of another embodiment of the disclosed concrete form spreader; and, FIG. 8 is a cross-sectional view of another embodiment of an end cap of the disclosed concrete form spreader.
Figure 8:
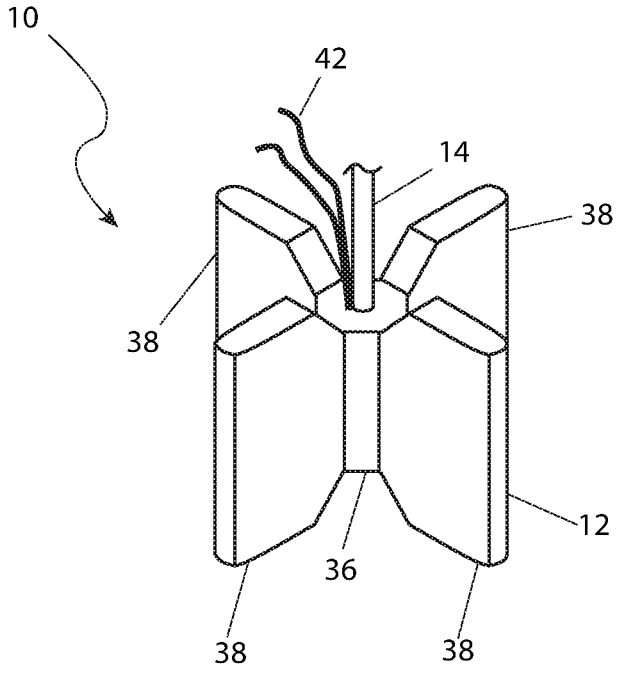

FIG. 7 is a schematic illustration of a side elevation view of another embodiment of the disclosed device 10. FIG. 8 is a schematic illustration of a partial section view of the device 10 depicting another embodiment of the end cap 12. As described above, the end cap 12 may have various alternate shapes depending on the specific application or implementation of the device 10 and/or required specifications of the concrete structure or the concrete formwork 54 (FIG. 1).

In the illustrated embodiment, each of the end caps 12 includes a body 36 and two (2) or more wings 38 extending radially outward from the body 36. Each pair of two (2) wings 38 may be directly opposite to one (1) another. The shape of the body 36 and the number of wings 38 may vary depending on the specific application or implementation of the device 10. In the illustrated embodiment, the body 36 has an octagonal prism shape. Four (4) equally spaced apart wings 38 extend from four (4) of the eight (8) sides of the body 36. In other embodiments, the body 36 may have other three-dimension shapes Similarly, different numbers of wings 38 may extend from the body 36, for example, depending upon the total number of side of the body 36.

The embodiment illustrated in FIG. 7 depicts the fixed device that includes a fixed length tie rod 14 coupled to the two (2) end caps 12. However, in other embodiments, the tie rod 14 may be adjustable, including the first tie rod section 18, the second tie rod section 20 and the turnbuckle 22, as illustrated in FIG. 4.

In an example construction of this embodiment, the end caps 12 are permanently connected (e.g., affixed) to the tie rod 14. For example, the end caps 12 may be concrete blocks formed, for example, cast, around each end 16 of the tie rod 14. In another example construction of this embodiment, the end caps 12 are removably connected (e.g., attached) to the tie rod sections 18, 20 via the coupling nut 28 embedded within the end cap 12. For example, the end caps 12 may be concrete blocks formed, for example, cast, around the coupling nut 28. In yet another example construction of this embodiment, the end caps 12 are permanently connected (e.g., affixed) to the tie rod sections 18, 20. For example, the end caps 12 are concrete blocks formed, for example, cast, around the first end 24 of each tie rod section 18, 20.

Referring to FIGS. 2, 3 and 5-8, in another embodiment, the device 10 includes integral tie wires 42. In an example construction, at least two (2) tie wires 42 are permanently connected (e.g., affixed) to each one (1) of the pair of end caps 12. As an example, the tire wires 42 may be cast within the concrete end caps 12 during the casting process. The tie wires 42 may extend from the end caps 12 in the same general direction as the tie rod 14. The tire wires 42 may be positioned adjacent to or otherwise in close proximity to the tie rod 14. As an example, the tire wires 42 may be sixteen-and-a-half (16½) gauge wire.

Referring to FIGS. 1-7, in the various embodiment, each one (1) of the end caps 12 includes a contacting face 40. As illustrated in FIG. 1, the contacting face 40 defines the surface of the end cap 12 that is configured to abut the concrete formwork 54. In the various embodiments of the end cap 12, the contacting surface is substantially flat.

The materials required to produce the device 10 are all readily available and well known to manufacturers of goods of this type. In a preferred embodiment, the end caps 12 are made of concrete that is precast around the tie rod 14 that is made of a pre-cut length of rebar. Individual forms may be needed for each type/model of device 10. Should large scale production of the disclosed device 10 be undertaken, suitable jigs and other assembly aids would be needed to speed production and ensure consistency. The raw materials as used in the disclosed device 10 would best be obtained from wholesalers and manufacturers that deal in goods of that nature and assembled at a final location. The relatively simple design of the invention and the material of construction make device 10 a cost-effective design due to the relatively low material and labor costs involved.

Those skilled in the art will recognize that other styles and configurations of the disclosed device 10 can be easily incorporated into the teachings of the present disclosure, and only particular configurations have been shown and described for purposes of clarity and disclosure and not by way of limitation of scope.

The foregoing descriptions of specific illustrated embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

The invention claimed is:

1. A concrete formwork spreading device, comprising:
- a tie rod having a pair of opposing ends; and
- a pair of end caps connected to said pair of opposing ends of said tie rod;
- wherein each one of said pair of end caps includes a contacting face;
- wherein said contacting face of each one of said pair of end caps is spaced apart by a distance, and wherein said distance is equal to a thickness of a concrete wall formed using said device;
- wherein each one of said pair of end caps includes a cubical shape;
- wherein each one of said pair of end caps includes a coupling nut; and
- wherein each one of said end caps includes cast concrete.

2. The device of claim 1, wherein said contacting face is flat.

3. The device of claim 1, wherein said distance between said contacting face of each one of said pair of end caps is adjustable.

4. The device of claim 1, wherein each one of said opposing ends of said tie rod is removably connected to an associated one of said pair of end caps.

5. The device of claim 1, wherein each one of said opposing ends of said tie rod is cast within an associated one of said pair of end caps.

6. The device of claim 1, wherein said coupling nut is cast within an associated one of said pair of end caps.

7. The device of claim 1, wherein each one of said pair of ends of said tie rod includes external thread, and wherein said one of said pair of ends is threadably connected to said coupling nut of an associated one of said pair of end caps.

8. The device of claim 1, wherein said tie rod comprises a length of steel reinforcing bar.

9. The device of claim 1, wherein said tie rod, comprises:
- a first tie rod section, said first tie rod section having a first one of said pair of ends;
- a second tie rod section, said second tie rod section having a second one of said pair of ends; and
- a turnbuckle interconnected between said first tie rod section and said second tie rod section;
- wherein rotation of said turnbuckle relative to said first tie rod section and said second tie rod section adjusts a relative distance between said first tie rod section and said second tie rod section.

10. The device of claim 1, wherein each one of said pair of end caps includes a plurality of integral tie wires extending therefrom.

11. The device of claim 1, wherein each one of said pair of end caps, comprises:
- a body; and
- at least two wings extending outwardly from said body.

* * * * *